US010981393B2

(12) United States Patent
Miyajima

(10) Patent No.: US 10,981,393 B2
(45) Date of Patent: Apr. 20, 2021

(54) LIQUID EJECTING APPARATUS AND MAINTENANCE METHOD THEREOF

(71) Applicant: SEIKO EPSON CORPORATION, Tokyo (JP)

(72) Inventor: Hiroki Miyajima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/657,653

(22) Filed: Oct. 18, 2019

(65) Prior Publication Data

US 2020/0122474 A1 Apr. 23, 2020

(30) Foreign Application Priority Data

Oct. 22, 2018 (JP) ..... JP2018-198238

(51) Int. Cl.
*B41J 2/175* (2006.01)
*B41J 2/14* (2006.01)

(52) U.S. Cl.
CPC ..... *B41J 2/17596* (2013.01); *B41J 2/14032* (2013.01); *B41J 2/17506* (2013.01); *B41J 2/17566* (2013.01)

(58) Field of Classification Search
CPC ..... B41J 2/17566; B41J 2/17596
See application file for complete search history.

(56) References Cited

U.S. PATENT DOCUMENTS

2003/0146958 A1* 8/2003 Aruga ..... B41J 2/17523 347/85
2012/0050422 A1* 3/2012 Kondo ..... B41J 2/17509 347/85
2015/0273851 A1 10/2015 Akahane et al.
2017/0151806 A1 6/2017 Kobayashi
2018/0043691 A1 2/2018 Udagawa et al.

FOREIGN PATENT DOCUMENTS

JP 2015-189201 A 11/2015
JP 2017-030276 A 2/2017
JP 2017-109445 A 6/2017
JP 2018-039124 A 3/2018

* cited by examiner

*Primary Examiner* — Matthew Luu
*Assistant Examiner* — Kendrick X Liu
(74) *Attorney, Agent, or Firm* — Workman Nydegger

(57) ABSTRACT

A liquid ejecting apparatus includes: a recording head that ejects liquid; a pressurizing mechanism that supplies the liquid under pressure; a valve-mechanism provided between the pressurizing mechanism and the recording head, the valve-mechanism including a liquid storage chamber storing the liquid supplied under pressure, a pressure chamber that is provided closer to the recording head than to the liquid storage chamber and stores the liquid, and a valve body that moves in a valve opening direction according to a negative pressure in the pressure chamber to communicate the liquid storage chamber with the pressure chamber; and a pressure control section controlling a pressure of the liquid supplied from the pressurizing mechanism to the valve-mechanism. The pressure control section controls the pressure of the liquid that is supplied under pressure by the pressurizing mechanism to the liquid storage chamber, to move the valve body in the valve opening direction.

13 Claims, 11 Drawing Sheets

LIQUID EJECTING APPARATUS AND MAINTENANCE METHOD THEREOF

The present application is based on, and claims priority from JP Application Serial Number 2018-198238, filed Oct. 22, 2018, the disclosure of which is hereby incorporated by reference herein in its entirety.

BACKGROUND

1. Technical Field

The present disclosure relates to a liquid ejecting apparatus and a maintenance method for the liquid ejecting apparatus.

2. Related Art

Liquid ejecting apparatuses such as printers includes a recording head that ejects liquid to a recording medium or the like. The recording head is provided with a pressure adjustment mechanism. The pressure adjustment mechanism has a function of opening and closing a valve according to a change in internal pressure and controlling the supply of liquid to the recording head. The liquid ejecting apparatus may supply liquid to the recording head under pressure and discharges the liquid from a nozzle, while keeping the valve opened, that is, performs so-called pressure cleaning. JP-A-2017-109445 discloses that, in the pressure cleaning, a flexible diaphragm provided in the adjustment mechanism is pressed by a pressing mechanism to forcibly open the valve. Hereinafter, the pressure adjustment mechanism will be referred to as "valve mechanism".

However, when the technique disclosed in JP-A-2017-109445 is applied to the configuration including a lot of valve mechanisms, in order to forcibly open the valve of each valve mechanism, it is necessary to provide a lot of pressing mechanism for pressing respective diaphragms. This makes the configuration of the valve mechanisms and the recording heads complicated, and the entire apparatus larger. Such problem is common to printers as well as the liquid ejecting apparatus including a plurality of valve mechanisms and recording heads.

SUMMARY

A liquid ejecting apparatus in accordance with an embodiment of the present disclosure is provided. The liquid ejecting apparatus includes a recording head having a nozzle that ejects liquid; a pressurizing mechanism that presses the liquid and supplies the pressed liquid; a valve mechanism provided between the pressurizing mechanism and the recording head, the valve mechanism including a liquid storage chamber that stores the pressed and supplied liquid, a pressure chamber that is provided closer to the recording head than the liquid storage chamber and stores the liquid, and a valve body that moves in a valve opening direction due to a negative pressure occurring in the pressure chamber, the movement of the valve body in the valve opening direction due to the negative pressure communicating the liquid storage chamber with the pressure chamber for flowing the liquid; and a pressure control section that controls a pressure of the liquid supplied from the pressurizing mechanism to the valve mechanism. The pressure control section controls the pressure of the liquid that is pressed and supplied by the pressurizing mechanism to the liquid storage chamber, to move the valve body in the valve opening direction.

In accordance with another embodiment of the present disclosure, there is provided a maintenance method of a liquid ejecting apparatus including: a recording head having a nozzle that ejects liquid; a pressurizing mechanism that presses the liquid and supplies the pressed liquid; and a valve mechanism provided between the pressurizing mechanism and the recording head, the valve mechanism including a liquid storage chamber that stores the pressed and supplied liquid, a pressure chamber that stores that is provided closer to the recording head than the liquid storage chamber and stores the liquid, and a valve body that moves in a valve opening direction due to a negative pressure occurring in the pressure chamber, the movement of the valve body in the valve opening direction due to the negative pressure communicating the liquid storage chamber with the pressure chamber for flowing the liquid. The maintenance method includes: controlling the pressure of the liquid supplied from the pressurizing mechanism to the valve mechanism; moving the valve body in the valve opening direction by controlling the pressure of the liquid that is pressed and supplied by the pressurizing mechanism to the liquid storage chamber; and in the state where the liquid storage chamber is communicated with the pressure chamber by moving the valve body in the valve opening direction, discharging the pressed and supplied liquid from the nozzle to clean the nozzle.

DESCRIPTION OF EXEMPLARY EMBODIMENTS

A. Embodiments

A1. Configuration of Liquid Ejecting Apparatus

Figure 1:
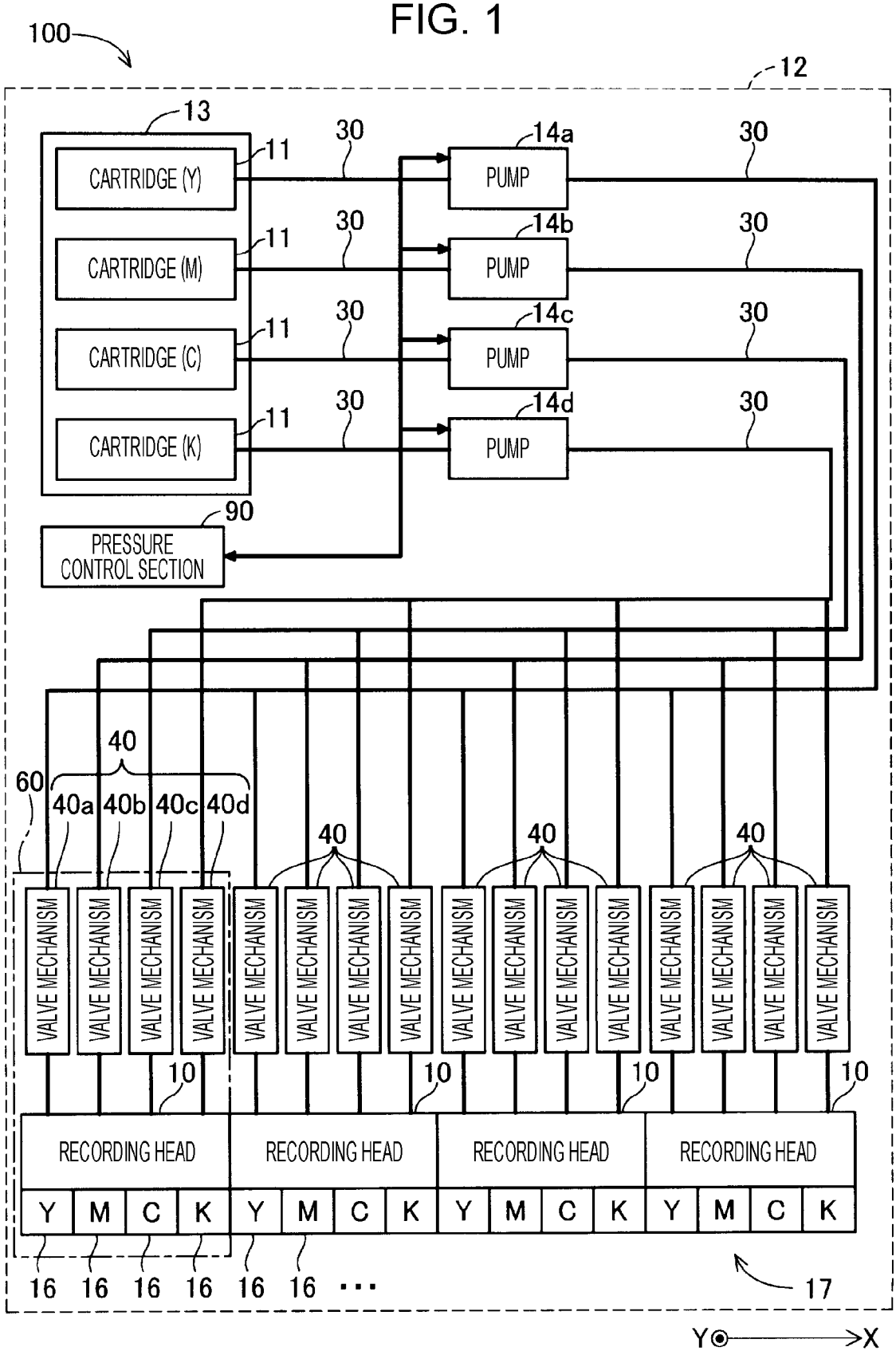
FIG. 1 is a view schematically illustrating the configuration of a liquid ejecting apparatus.

FIG. 1 is a view schematically illustrating a liquid ejecting apparatus 100 in accordance with an embodiment of the present disclosure. The liquid ejecting apparatus 100 is configured as an ink jet printer having a line head 17. The liquid ejecting apparatus 100 includes a plurality of cartridges 11 that store liquid, a plurality of recording heads 10 that constitute the line head 17, liquid paths 30 that extend from the respective cartridges 11 to the respective recording heads 10, and a pressure control section 90 that controls the pressure of the liquid. The X direction illustrated in FIG. 1 is a horizontal direction in which the plurality of recording heads 10 are aligned. The recording medium is horizontally transported in the Y direction perpendicular to the X direction by way of a transport mechanism not illustrated. The recording medium may be any material capable of holding liquid, such as paper, plastics, films, fibers, fabrics, leather, glass, wood, and ceramics.

The different cartridges 11 stores different types of ink and are attached to a cartridge attachment section 13 in a housing 12 of the liquid ejecting apparatus 100. In this embodiment, the liquid ejecting apparatus 100 is a so-called off-carriage type printer such that the cartridge attachment section 13 and a carriage not illustrated are provided at different sites. The above-mentioned "type of ink" means color of ink, and the cartridges 11 store respective ink of four colors of yellow, magenta, cyan, and black. The colors of the ink stored in the cartridges 11 are not limited to yellow, magenta, cyan, and black and may be any other color including light cyan, light magenta, red, blue, green, white and clear. The type of ink may be the type of color material, for example, dyes and pigments. Each of the cartridges 11 is connected to the liquid path 30 for each ink.

The liquid paths 30 each are a path for supplying the ink from the cartridge 11 to the recording head 10. The liquid paths 30 are provided with a plurality of pumps 14*a* to 14*d* and a plurality of valve mechanisms 40 from the upstream side (cartridge 11 side) toward the downstream side (recording head 10 side).

The pumps 14*a* to 14*d* each suck the ink from the cartridge 11, press the sucked ink to a pressure controlled by a below-described pressure control section 90, and supply the pressed ink to valve mechanisms 40. In this embodiment, the pumps 14*a* to 14*d* each are formed of a diaphragm pump. The pumps 14*a* to 14*d* each correspond to a subordinate concept of a pressurizing mechanism as means for solving problems.

The valve mechanisms 40 each are provided between the pumps 14*a* to 14*d* and the recording head 10 in each liquid path 30, and are aligned in the X direction. As represented by the valve mechanisms 40 on the left side in FIG. 1, the valve mechanisms 40 are provided as the valve mechanisms 40*a* to 40*d* for different colors. When the valve mechanisms 40*a* to 40*d* are not distinguished from one another, they are collectively referred to as merely "valve mechanism 40". The valve mechanism 40 includes a valve body that operates according to the pressure on the side of the recording head 10. When the ink is consumed on the side of the recording head and the pressure on the side of the recording head 10 falls below a predetermine pressure, the valve body is opened and the pressed ink is supplied from the pump 14 to the recording heads 10. The valve mechanism 40 will be described later in detail.

The recording heads 10 ejects ink of four colors including yellow Y, magenta M, cyan C, and black K. A plurality of nozzles 16 for ejecting the ink are provided on a face of each recording head 10, which is opposed to the recording medium. In this embodiment, the recording head 10 is a piezo-type head and the nozzles 16 each include a piezo actuator for ejecting the ink. The recording head 10 is not limited to the piezo-type head and may be a thermal-type head. In following description, the four valve mechanisms 40*a* to 40*d* and the single recording head 10 are referred to as a head unit 60.

The pressure control section 90 controls each of the pumps 14*a* to 14*d* to control the pressure of the ink supplied to the valve mechanism 40. In this embodiment, the pressure control section 90 controls the pressure of the ink so as to increase at normal time, at the pressure cleaning, and at opening of the valve body in this order.

Figure 2:
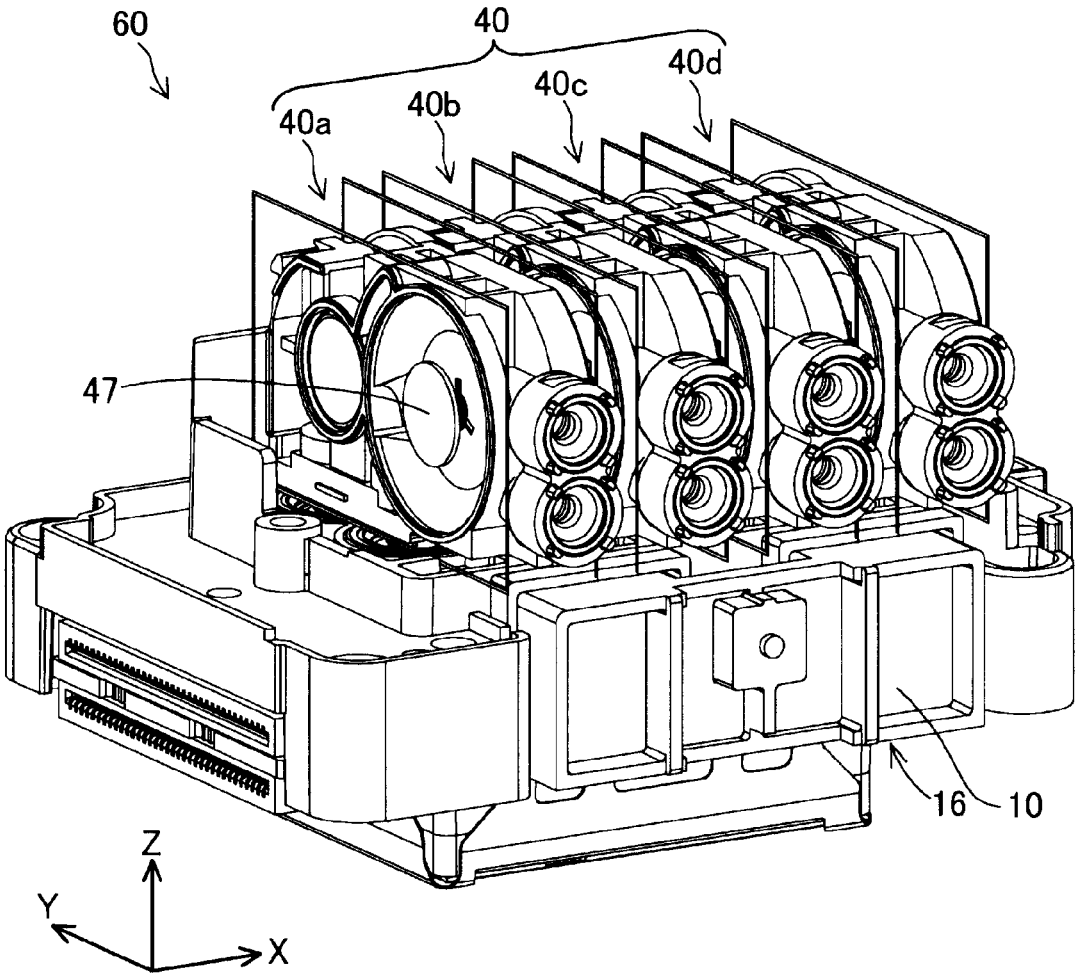
FIG. 2 is a perspective view of the appearance of a head unit.

FIG. 2 is a perspective view of the appearance of the head unit 60. In FIG. 2, the Z direction is vertical direction, the +Z direction is the vertical upward direction, and the −Z direction is the vertical downward direction. As illustrated in FIG. 2, the recording head 10 and the valve mechanism 40 are configured of separate bodies. The nozzles 16 are provided on the −Z direction side of the recording head 10, and on the upper side of the recording head 10, the valve mechanisms 40*a* to 40*d* are aligned in the X direction and attached to the attachment sections not illustrated.

A2. Configuration and Action of Valve Mechanism

Figure 3:
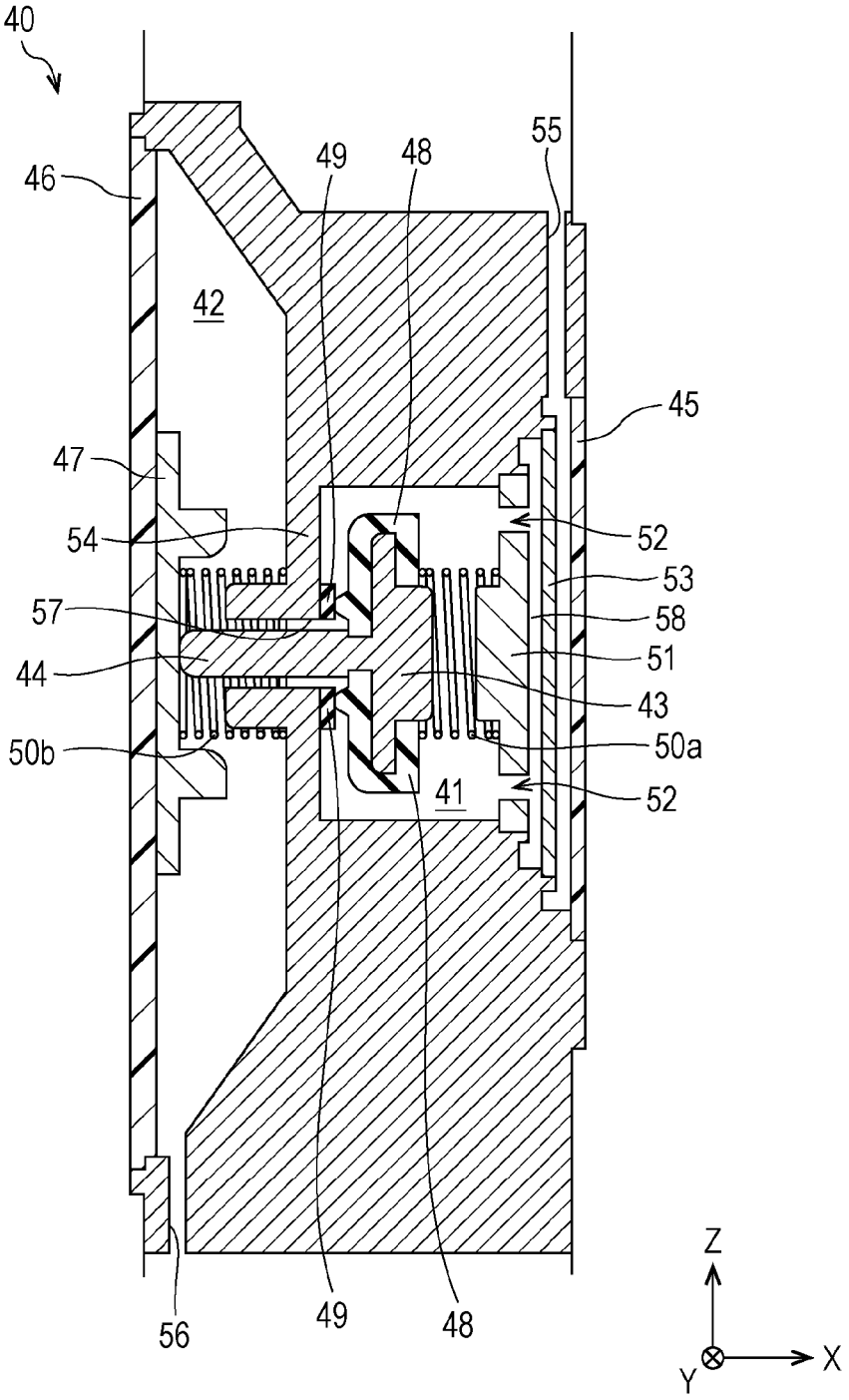
FIG. 3 is a sectional view schematically illustrating the configuration of a valve mechanism.
Figure 4:
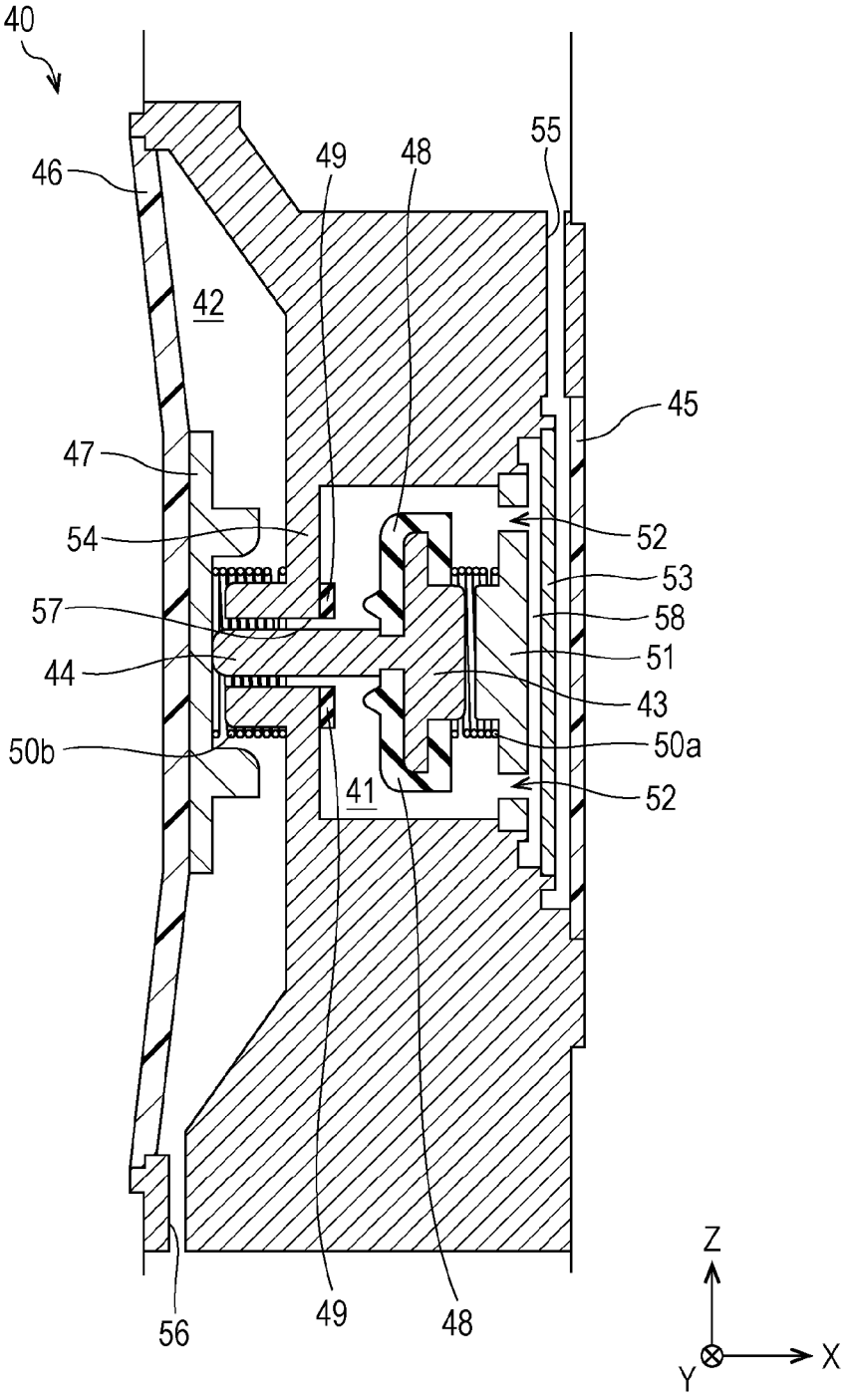
FIG. 4 is a sectional view schematically illustrating the configuration of the valve mechanism.

FIGS. 3 and 4 are sectional views schematically illustrating the configuration of the valve mechanism 40. FIGS. 3 and 4 are sectional views of the valve mechanism 40*a* illustrated in FIG. 2 cut along an X-Z plane passing the valve body. In FIGS. 3 and 4, for the sake of clarity, some lines are omitted. The valve mechanism 40 includes a liquid storage chamber 41 connected to the cartridge 11 via a supply port 55, and a pressure chamber 42 connected to the recording head 10 via a discharge port 56. The liquid storage chamber 41 is separated from the pressure chamber 42 with a partition wall 54. The partition wall 54 has a communication hole 57. An internal space of the liquid storage chamber 41 communicates with an internal space of the pressure chamber 42 via the communication hole 57. First, the configuration on the side of the liquid storage chamber 41 will be described. The liquid storage chamber 41 is provided with a valve body 43, a spring member 50*a*, a support member 51, a filter 53, and a first separation wall 45.

The valve body 43 is an on-off valve that switches between the state where ink is allowed to flow from the liquid storage chamber 41 to the pressure chamber 42 and the state where ink is not allowed to flow from the liquid storage chamber 41 to the pressure chamber 42. FIG. 3 illustrates the state where ink is not allowed to flow from the liquid storage chamber 41 to the pressure chamber 42. FIG. 4 illustrates the state where ink is allowed to flow from the liquid storage chamber 41 to the pressure chamber 42. As recognized more clearly by comparing FIG. 3 with FIG. 4, when the valve body 43 moves in the +X direction that is the valve opening direction, the valve body 43 is opened and ink flows from the liquid storage chamber 41 to the pressure chamber 42. When the valve body 43 moves in the −X direction that is the valve closing direction, the valve body 43 is closed and ink does not flow from the liquid storage chamber 41 to the pressure chamber 42. Opening/closing of the valve body 43 and the flow of ink in the valve mechanism 40 will be described later in detail.

As illustrated in FIG. 3, the valve body 43 has a shaft 44 protruding in the −X direction. An end of the shaft 44 on the −X direction side is in contact with a below-described pressure reception plate 47.

As illustrated in FIG. 3, the valve body 43 includes an annular seal member 48. The seal member 48 is disposed so as to cover a portion of the valve body 43, which protrudes in the Z direction. A valve seat 49 is formed of a cylindrical rubber member. In the state where the valve body 43 is opened, the seal member 48 is pressed against the valve seat 49 provided on the face of the partition wall 54 on the +X direction side. This blocks ink from flowing from the liquid storage chamber 41 to the pressure chamber 42. Conversely, as illustrated in FIG. 4, in the state where the valve body 43 is opened, the seal member 48 is not in contact with the valve seat 49, allowing ink to flow from the liquid storage chamber 41 to the pressure chamber 42.

As illustrated in FIG. 3, the spring member 50*a* is provided on the −X direction side of the support member 51. The spring member 50*a* biases the valve body 43 toward the partition wall 54 (−X direction). In the state where the valve body 43 is closed, the spring member 50*a* presses the valve seat 49 and the valve body 43 onto the partition wall 54. Conversely, as illustrated in FIG. 4, in the state where the valve body 43 is opened, the spring member 50*a* is pressed onto the support member 51 by the valve body 43. The support member 51 supports the spring member 50*a*. The support member 51 has a through hole 52. The through hole 52 functions as an ink flow path. A space 58 is provided on the +X direction side of the support member 51, that is, on the opposite side to the liquid storage chamber 41. The space 58 communicates with the supply port 55 via the filter 53. The filter 53 is disposed on the +X direction side of the support member 51. The filter 53 traps foreign substances contained in ink. Ink flowing through the supply port 55 is stored in the liquid storage chamber 41 via the filter 53, the space 58, and the through hole 52.

The first separation wall 45 is provided on the outermost circumference of the valve mechanism 40 in the +X direction. The first separation wall 45 separates the liquid storage chamber 41 from the outside of the valve mechanism 40 in the +X direction. The first separation wall 45 is formed of an elastic thin film, and deforms according to the pressure in the liquid storage chamber 41. When the pressure in the liquid storage chamber 41 increases, the first separation wall 45 deforms toward the outside (+X direction side) of the valve mechanism 40 by a deformation amount corresponding to such pressure.

Next, the configuration on the side of the pressure chamber 42 is described. The pressure chamber 42 is provided with a second separation wall 46, the pressure reception plate 47, and a spring member 50*b*. The second separation wall 46 is disposed on the outermost side (−X direction side) of the pressure chamber 42. The second separation wall 46 separates the pressure chamber 42 from the outside of the valve mechanisms 40 in the −X direction. Like the first separation wall 45, the second separation wall 46 is formed of an elastic thin film, and deforms according to the pressure in the pressure chamber 42. The first separation wall 45 and the second separation wall 46 each may be a snap action mechanism that largely deforms with a certain pressure or more.

The pressure reception plate 47 is disposed on the separation wall 46 on the side of the second pressure chamber 42. The pressure reception plate 47 receives the pressure applied to the second separation wall 46 toward the pressure chamber 42. That is, the pressure reception plate 47 is pressed toward the partition wall 54 due to the deformation of the second separation wall 46 toward the pressure chamber 42. At this time, the shaft 44 and the valve body 43 moves away from the valve seat 49.

The spring member 50*b* is provided on the pressure reception plate 47. The spring member 50*b* biases the pressure reception plate 47 in the −X direction with respect to the partition wall 54. When the pressure in the pressure chamber 42 lowers to the atmospheric pressure or less, the second separation wall 46 deforms toward the pressure chamber 42 side (+X direction side).

Next, the action of the valve mechanisms 40 is described. As illustrated in FIG. 3, pressed ink is supplied to the liquid storage chamber 41 via the supply port 55 and the liquid paths 30. When the ink is ejected from the nozzle 16 of the recording head 10, the flow path in the recording head 10 becomes a negative pressure, and the pressure is transmitted to the valve mechanism 40 located upstream of the recording head 10. When the pressure in the pressure chamber 42 decreases to a negative pressure that is lower than the atmospheric pressure, as illustrated in FIG. 4, the second separation wall 46 is bent toward the pressure chamber 42 (+X direction). Then, when the pressure in the pressure chamber 42 becomes a predetermined negative pressure, with the deformation of the second separation wall 46, the pressure reception plate 47 is pressed and moves toward the partition wall 54. At this time, the pressure reception plate 47 presses a tip of the shaft 44 to move the valve body 43 in the valve opening direction (+X direction). Then, the valve body 43 is opened, thereby communicating the liquid storage chamber 41 with the pressure chamber 42. A value of the predetermined negative pressure in the pressure chamber 42 at the time when the valve body 43 is opened to communicate the liquid storage chamber 41 with the pressure chamber 42 is set according to the desired shape of a meniscus of the nozzle 16 at ejection.

Since ink supplied into the liquid storage chamber 41 is pressed by the pump 14, when the ink is supplied into the liquid storage chamber 41, the pressure in the liquid storage chamber 41 increases. Further, the pressed ink flows from the liquid storage chamber 41 to pressure chamber 42, thereby increasing the pressure in the pressure chamber 42. As a result, the second separation wall 46 deforms to the outside of the valve mechanisms 40 (−X direction side). With the deformation of the second separation wall 46, the pressure reception plate 47 and the valve body 43 move in the −X direction that is the valve closing direction and as illustrated in FIG. 3, the valve body 43 is closed. At this time, the seal member 48 is in contact with the valve seat 49, thereby blocking ink from flowing from the liquid storage chamber 41 to the pressure chamber 42.

As described above, the valve mechanism 40 controls the flow of ink from the cartridge 11 to the recording head 10 by allowing the valve body 43 to move in the valve opening direction or the valve closing direction according to the pressure in the pressure chamber 42. The valve mechanisms 40 may be referred to as "self-sealing valve" or "differential pressure valve". The valve mechanisms 40 also serves to separate the negative pressure in the recording head 10 from the positive pressure on the side of the cartridge 11 such that a pressing force is directly applied from the pump 14 to the recording head 10 under negative pressure.

A3. Control of Pressurized Cleaning of Valve Mechanism

First, the summary of pressure cleaning of the valve mechanism 40 is described. In this embodiment, the "pressure cleaning" means that, for maintenance of the nozzle 16, ink is forcibly passed from the cartridge 11 to the nozzle 16 and discharged from the nozzle 16. In the pressure cleaning, the pressure chamber 42 needs to be continuously pressed to maintain the opened state of the valve body 43. Since the negative pressure is maintained on the side of the recording head 10 located downstream of the valve mechanisms 40, in order to perform the pressure cleaning, the valve mechanism 40 needs to release such negative pressure and bring the side of the recording head 10 into the positive pressure state. As illustrated in FIGS. 3 and 4, in the valve mechanism 40, no member that forcibly presses the second separation wall 46*d* to open the valve body 43 is disposed on the outside (−X direction side) of the second separation wall 46*d*. In this embodiment, by controlling the pressure of the pressed ink supplied to each of the valve mechanisms 40*a* to 40*d*, the corresponding one of the first separation wall 45*a* to 45*d* of one of the valve mechanisms 40*a* to 40*d* is deformed in the +X direction, and by pressing the corresponding one of the second separation wall 46*a* to 46*d* of another one of the valve mechanism 40*a* to 40*d* disposed next to the one of the valve mechanisms 40*a* to 40*d* in the +X direction, the corresponding one of the valve bodies 43*a* to 43*d* of the another one of the valve mechanisms 40*a* to 40*d* is opened to bring the side of the recording heads 10 into the positive pressure state. This will be specifically described below.

Figure 5:
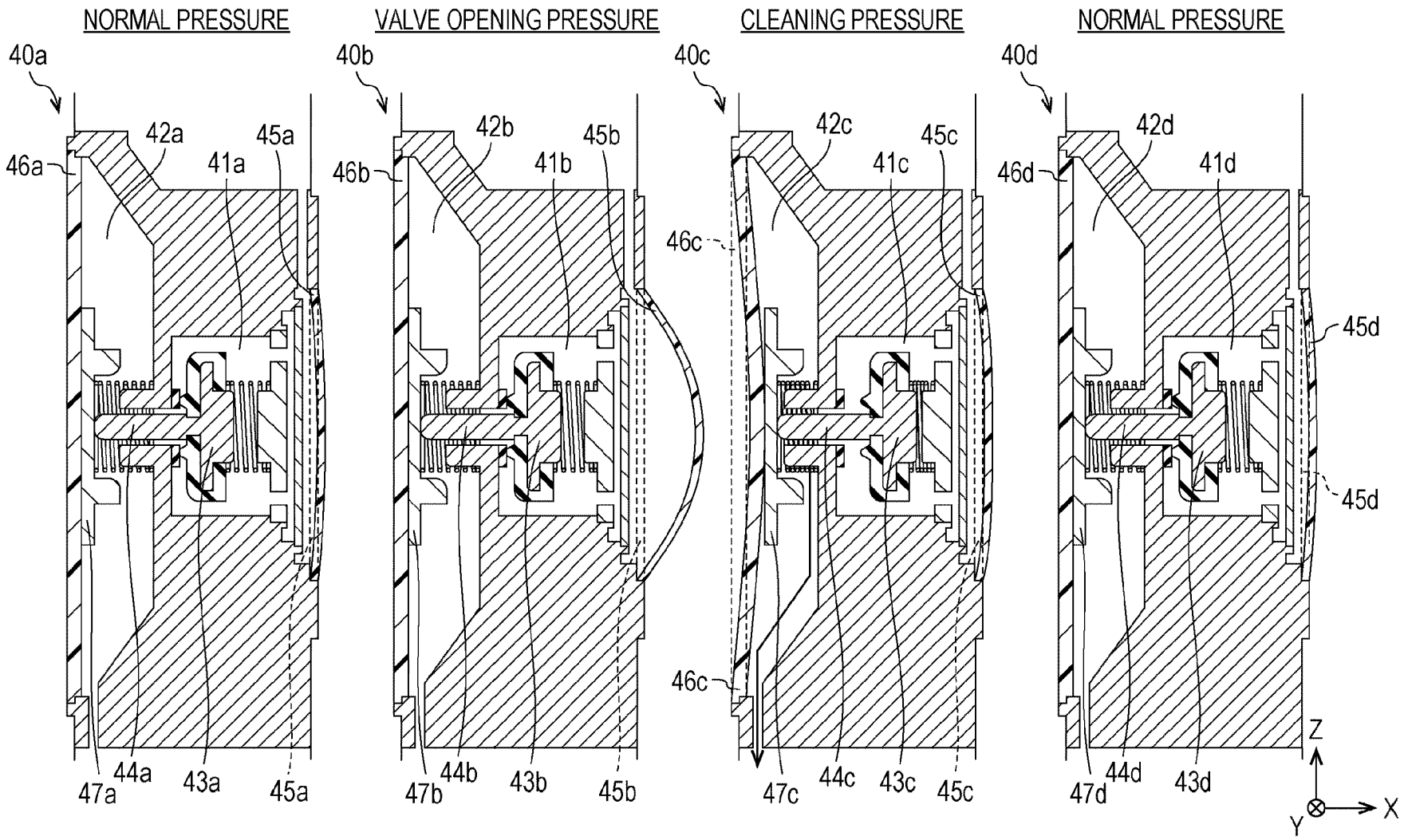
FIG. 5 is a sectional view schematically illustrating the control of pressure cleaning in the four valve mechanisms.

FIG. 5 is a sectional view schematically illustrating the control of the pressure cleaning in the four valve mechanisms 40*a* to 40*d*. In FIG. 5, for convenience of illustration, reference numerals of some components of the valve mechanisms 40 are omitted. Suffixes a to d corresponding to the valve mechanisms 40*a* to 40*d* are assigned to the components having respective reference numerals. In following description, for convenience, the valve mechanisms 40*a* to 40*d* may be also referred to as the first valve mechanism 40*a*, the second valve mechanism 40*b*, the third valve mechanism 40*c*, and the fourth valve mechanism 40*d*. In the example illustrated in FIG. 5, the pressure cleaning is applied to the nozzle 16 of the recording head 10 located downstream of the third valve mechanism 40*c* among the four valve mechanisms 40*a* to 40*d*.

As illustrated in FIG. 5, the valve mechanisms 40*a* to 40*d* are disposed such that the first separation walls 45*a* to 45*d* are opposed to the second separation walls 46*a* to 46*d* of the adjacent valve mechanisms 40*a* to 40*d* in the +X direction, respectively. For example, the first valve mechanism 40*a* is disposed such that the first separation wall 45*a* is opposed to the second separation wall 46*b* of the adjacent second valve mechanism 40*b* in the +X direction. This also applies to the second valve mechanisms 40*b* and the third valve mechanism 40*c*, as well as the third valve mechanisms 40*c* and the fourth valve mechanism 40*d*.

First, the pressure of the ink supplied to each of the valve mechanisms 40*a* to 40*d* is described. As illustrated in FIG. 5, ink pressed with normal pressure is supplied to the first valve mechanism 40*a* and the fourth valve mechanism 40*d*. The "normal pressure" means the pressing amount for ink during normal use. Ink pressed with a valve-opening pressure is supplied to the second valve mechanisms 40*b*. The valve-opening pressure is a pressing amount that is larger than the normal pressure. Ink pressed with a cleaning pressure is supplied to the third valve mechanisms 40*c*. The cleaning pressure is larger than the valve-opening pressure, and can be applied up to the nozzle 16. The valve body 43 of the valve mechanism 40 is not opened with any of the normal pressure, the valve pressure, and the cleaning pressure. A value of the valve-opening pressure corresponds to a subordinate concept of a predetermined pressure value in other embodiments.

As discussed above, since ink is supplied to the liquid storage chamber 41*a* of the first valve mechanism 40*a* with the smaller normal pressure than the valve-opening pressure, a deformation amount of the first separation wall 45*a* in the +X direction is relatively small. Accordingly, the second separation wall 46*b* of the second valve mechanism 40*b* adjacent to the first valve mechanism 40*a* is not pressed by the first separation wall 45*a* of the first valve mechanism 40*a*. In FIG. 5, each of the separation wall 45*a* to 45*d* and 46*a* to 46*d* before deformation is represented by a broken line.

In the second valve mechanism 40*b*, ink is supplied to the liquid storage chamber 41*b* with the valve-opening pressure. For this reason, the pressure in the liquid storage chamber 41*b* increases than normal, and the first separation wall 45*b* deforms toward the outside (+X direction side) of the valve mechanisms 40*b*. At this time, the first separation wall 45*b* presses the second separation wall 46*c* of the third valve mechanisms 40*c* toward the inside (+X direction side) of the pressure chamber 42*c* of the third valve mechanism 40*c*. Accordingly, the pressure reception plate 47*c* moves in the +X direction, and the shaft 44*c* and the valve body 43*c* move in the valve opening direction. Here, since ink is supplied to the liquid storage chamber 41*c* in the third valve mechanism 40*c* with the smaller cleaning pressure than the valve-opening pressure, the pressed ink flows into the pressure chamber 42*c* and is supplied to the recording head 10. Then, the pressure of the pressed ink is transmitted to the recording head 10, allowing the nozzle 16 to discharge ink.

In the third valve mechanism 40*c*, after ink for cleaning is discharged on the side of the recording head 10, even when ink is supplied from the cartridge 11 to the valve mechanism 40, the pressure in the liquid storage chamber 41*c* do not largely increase. Accordingly, as illustrated in FIG. 5, the deformation amount of the first separation wall 45*c* of the third valve mechanism 40*c* in the +X direction is relatively small and thus, the second separation wall 46*d* of the fourth valve mechanism 40*d* is not pressed in the +X direction.

In the fourth valve mechanism 40*d*, like the first valve mechanism 40*a*, since ink is supplied with the normal pressure, the deformation amount of the first separation wall 45*d* in the +X direction is relatively small.

As has been described above, in the valve mechanisms 40 to be subjected to the pressure cleaning, ink pressed with the cleaning pressure is supplied. In another valve mechanism 40 located next to the second separation wall 46 of the valve mechanism 40 to be subjected to the pressure cleaning, ink pressed with the valve-opening pressure is supplied to the second separation wall 46*c* of the valve mechanisms 40 to be subjected to pressure cleaning to deform the second separation wall 46*c*, thereby opening the valve body 43. By controlling the pressure of the ink supplied to the valve mechanism 40 in this manner, the valve body 43 of the valve mechanism 40 to be subjected to the pressure cleaning may be opened. In addition, useless consumption of ink in the valve mechanism 40 that is not subjected to the pressure cleaning may be suppressed.

Figure 6:
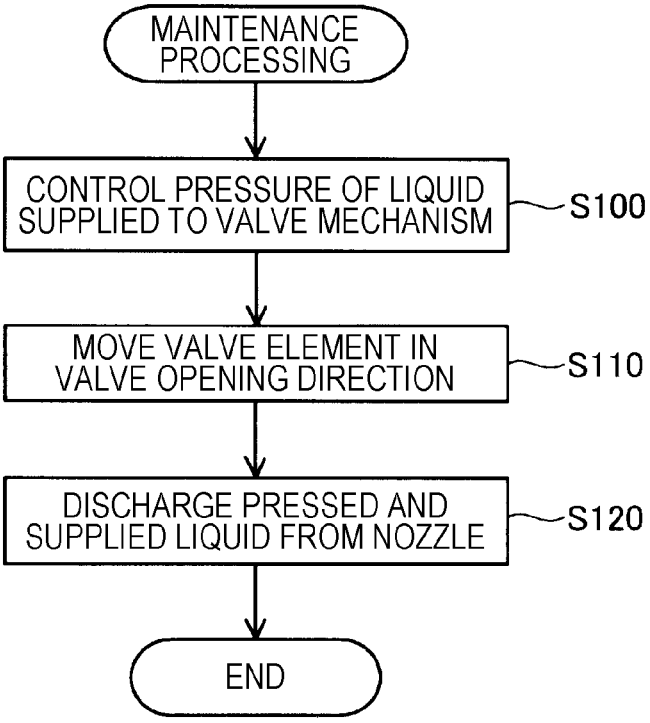
FIG. 6 is a flow chart illustrating the procedure of maintenance processing of the liquid ejecting apparatus.

FIG. 6 is a flow chart illustrating the procedure of maintenance processing of the liquid ejecting apparatus 100. The maintenance processing is executed in performing the above-mentioned pressure cleaning for maintenance or repair of the manufactured liquid ejecting apparatus 100. First, in Step S100, the pressure control section 90 controls the pressure of the ink supplied to the valve mechanisms 40*a* to 40*d*. Specifically, the pressure control section 90 controls the pressure of the ink supplied to the valve mechanisms 40 to be subjected to the pressure cleaning (in the example illustrated in FIG. 5, the third valve mechanisms 40*c*) to the pressing amount of the cleaning pressure. The pressure control section 90 controls the pressure of the ink supplied to another valve mechanism 40 not to be cleaned (in the example illustrated in FIG. 5, the valve mechanisms 40*a*, 40*b*, and 40*c*) to the amount with which the valve bodies 43*a*, 43*b*, and 43*d* of the other valve mechanisms 40*a*, 40*b*, and 40*c* are not opened. For example, as in the example illustrated in FIG. 5, the pressure of the ink supplied to the first valve mechanisms 40*a* and the fourth valve mechanisms 40*d* may be controlled to the pressing amount of the normal pressure, and the pressure of the ink supplied to the second valve mechanism 40*b* may be controlled to the pressing amount of the valve-opening pressure with which the valve body 43*c* of the third valve mechanism 40*c* is opened.

Subsequently, as illustrated in FIG. 6, in Step S110, the pressure control section 90 drives the pump 14 to supply pressed ink to each of the valve mechanisms 40*a* to 40*d*, thereby moving the valve body 43 in the valve opening direction. Next, in Step S120, the pressure control section 90 discharges the supplied pressed ink from the nozzle 16 to clean the nozzle 16.

The liquid ejecting apparatus 100 in this embodiment described above includes the recording heads 10, the pressurizing mechanism 14 that presses ink and supplies the pressed ink, the valve mechanism 40 that opens the valve body 43 due to the negative pressure occurring in the pressure chamber 42, allowing the ink to flow from the liquid storage chamber 41 to the pressure chamber 42, and the pressure control section 90 that controls the pressure of the ink supplied from the pressurizing mechanism 14 to the valve mechanism 40. Here, the pressure control section 90 causes the pressurizing mechanism 14 to control the pressure of the ink supplied to the liquid storage chamber 41, thereby moving the valve body 43 in the valve opening direction. Thus, as compared to the configuration further including a member for moving the valve body 43 in the valve opening direction, the valve body 43 may be opened with simpler configuration. In addition, the configuration of the valve mechanisms 40 and the recording heads 10 may be suppressed from becoming complicated and bulky. Further, any special valve configuration for the pressure cleaning is not required.

The valve mechanism 40 further includes the first separation wall 45 that is elastically deformable due to the pressure in the liquid storage chamber 41 and the second separation wall 46 that is elastically deformable due to the pressure in the pressure chamber 42, and the pressure control section 90 controls so as to make the pressure of the ink supplied to the liquid storage chamber 41 higher than a predetermined pressure value, to deform the first separation wall 45 such that the second separation wall 46 deforms toward an inside of the pressure chamber 42, thereby opening the valve body 43. The valve body 43 may be forcibly opened by controlling the pressure of the pressed ink supplied to the liquid storage chamber 41 in this manner.

In addition, since the first separation wall 45*b* of the second valve mechanisms 40*b* among the plurality of valve mechanisms 40*a* to 40*d* is deformed to deform the second separation wall 46 of the third valve mechanisms 40*c* toward the inside of the pressure chamber 42*d* of the third valve mechanism 40*c*, thereby opening the valve body 43*c* of the third valve mechanism 40*c*, as compared to the configuration in which the plurality of valve mechanisms 40*a* to 40*d* each include a member for moving the valve body 43 in the valve opening direction, the valve body 43 may be opened with more simple configuration. In addition, the configuration of the valve mechanism 40 and the recording head 10 may be suppressed from being complicated and bulky. Similarly, the first valve mechanism 40*a* may open the valve body 43*b* of the second valve mechanism 40*b*, and the third valve mechanisms 40*c* may open the valve body 43*d* of the fourth valve mechanism 40*d*.

Further, the nozzle may be easily cleaned by discharging the ink that is pressed and supplied by the pressurizing mechanism 14 through the nozzle 16. Since the pressure of the ink supplied to the third valve mechanism 40*c* corresponding to the nozzle 16 to be cleaned is controlled to the pressure with which the valve bodies 43*a*, 43*b*, and 43*d* of the valve mechanisms 40*a*, 40*b*, and 40*d* other than the third valve mechanism 40*c* to be cleaned, cleaning may be performed only in the third valve mechanism 40*c* to be cleaned.

B. Other Embodiments

B1. Embodiment 1

Figure 7:
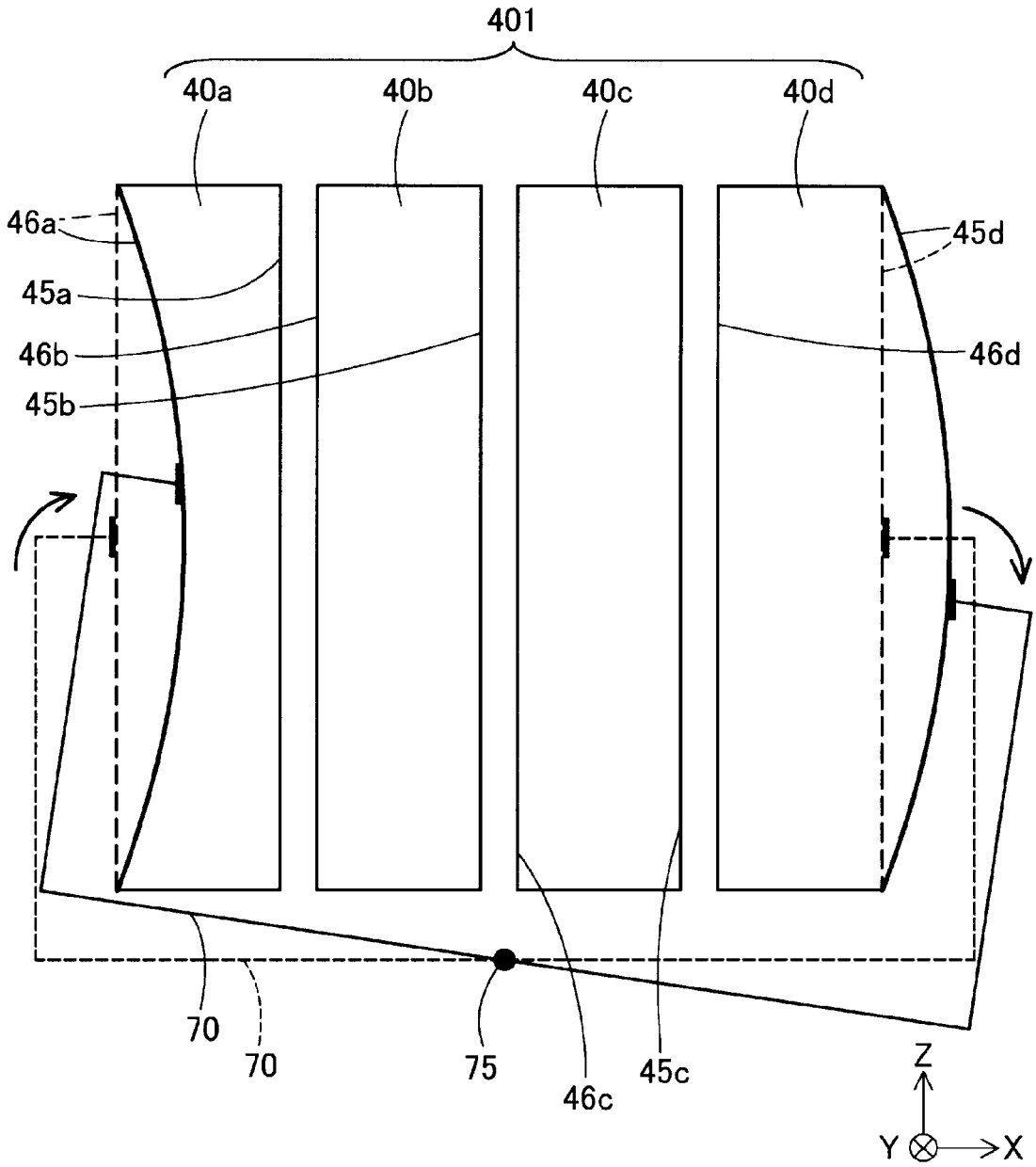
FIG. 7 is a view schematically illustrating of a valve mechanism in accordance with Embodiment 1.

FIG. 7 is a view schematically illustrating a valve mechanism 401 in Embodiment 1. In FIG. 7 and following description, the same components as in the above-mentioned embodiment are given the same reference numerals and description thereof is omitted. The valve mechanisms 401 in Embodiment 1 is different from the valve mechanism 40 in the above-described embodiment in that a rotation member 70 is further provided.

As represented by broken lines, the rotation member 70 is attached to the valve mechanism 401 so as to pinch the two valve mechanisms 40*a*, 40*d* disposed on both ends in the X direction among the four valve mechanisms 40*a* to 40*d*. Specifically, the rotation member 70 is disposed to pinch the second separation wall 46*a* of the first valve mechanisms 40*a* and the first separation wall 45*d* of the fourth valve mechanisms 40*d*. The rotation member 70 is used to press the second separation wall 46*a* of the first valve mechanisms 40*a*.

Specifically, when ink is supplied to the fourth valve mechanisms 40*d* with the above-mentioned valve-opening pressure, the pressure in the liquid storage chamber 41*d* of the fourth valve mechanisms 40*d* increases such that the first separation wall 45*d* is bent in the +X direction as represented by a solid line. With such deformation of the first separation wall 45*d*, the rotation member 70 rotates about a rotation axis 75 in parallel to the X-Z plane. When the rotation member 70 rotates, on the side of the first valve mechanism 40*a*, the second separation wall 46*a* is pressed by the rotation member 70 in the +X direction and is bent in the +X direction as represented by a solid line. Then, the valve body 43*a* of the first valve mechanism 40*a* moves in the valve opening direction to open the first valve mechanism 40*a*.

In such configuration, the deformation of the first separation wall 45*d* of the fourth valve mechanism 40*d* located at an end on the +X direction side causes the second separation wall 46*a* of the first valve mechanism 40*a* located at an end of the −X direction side to displace toward the pressure chamber 42 (+X direction side), thereby opening the first valve mechanisms 40*a*. Also in this configuration, the same effects as those in the above-described embodiment are achieved. The rotation member 70 corresponds to the subordinate concept of the pressing member in other embodiments.

B2. Embodiment 2

Figure 8:
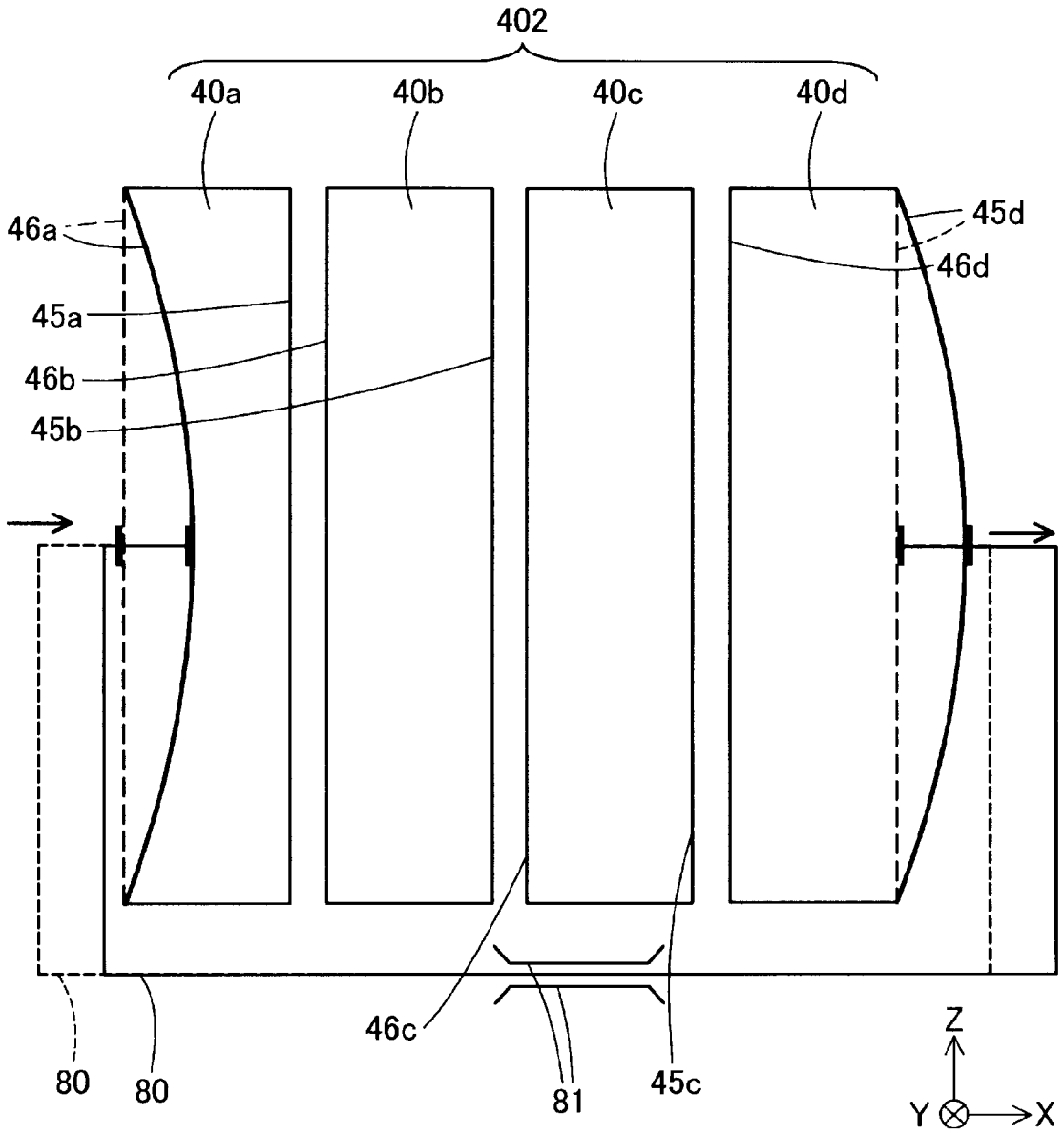
FIG. 8 is a view schematically illustrating of a valve mechanism in accordance with Embodiment 2.

FIG. 8 is a view schematically illustrating of a valve mechanism 402 in accordance with Embodiment 2. The valve mechanism 402 in Embodiment 2 is different from the valve mechanism 401 in Embodiment 1 in that a slide member 80 is provided in place of the rotation member 70.

As represented by broken lines, the slide member 80 is attached to the valve mechanism 402 so as to pinch the two valve mechanisms 40*a* and 40*d* located at both ends in the X direction among the four valve mechanisms 40*a* to 40*d*, more accurately, the second separation wall 46*a* of the first valve mechanism 40*a* and the first separation wall 45*d* of the fourth valve mechanism 40*d*. Like the rotation member 70, the slide member 80 is used to press the second separation wall 46*a* of the first valve mechanism 40*a*. The slide member 80 includes a guide member 81. The guide member 81 supports the slide member 80 such that the slide member 80 moves in parallel to the X direction. That is, the slide member 80 may reciprocate along the guide member 81.

Specifically, as in Embodiment 1, when ink is supplied to the fourth valve mechanism 40*d* with the valve-opening pressure, the pressure in the liquid storage chamber 41*d* of the fourth valve mechanism 40*d* increases such that the first separation wall 45*d* is bent in the +X direction as represented by a solid line. With such deformation of the first separation wall 45*d*, the slide member 80 moves along the guide member 81 in parallel to the +X direction. When the slide member 80 moves in parallel, on the side of the first valve mechanism 40*a*, the second separation wall 46*a* is pressed in the +X direction by the slide member 80 and is bent in the +X direction as represented by a solid line. Then, the valve body 43*a* of the first valve mechanism 40*a* moves in the valve opening direction to open the first valve mechanism 40*a*. Also in this configuration, the same effects as those in Embodiment 1 are achieved. The slide member 80 corresponds to a subordinate concept of the pressing member in other embodiments.

B3. Embodiment 3

In Embodiments 1 and 2, the rotation member 70 and the slide member 80 are attached to valve mechanisms 401 and 402, respectively, so as to pinch the first valve mechanisms 40*a* and the fourth valve mechanisms 40*d*, which are located at both ends in the X direction, in the valve mechanisms 401 and 402 consisting of the plurality of valve mechanisms 40*a* to 40*d*. On the contrary, the rotation member 70 and the slide member 80 may be attached to one valve mechanism 40, that is, each of the valve mechanisms 40*a* to 40*d*. For example, the rotation member 70 and the slide member 80 may be attached to the first valve mechanism 40*a* so as to pinch the first separation wall 45*a* and the second separation wall 46*a* of the first valve mechanisms 40*a*, or may be attached to each of the valve mechanisms 40*b* to 40*d* in a similar manner. In place of the rotation member 70 and the slide member 80, a spring member capable of pressing the second separation wall 46 from the outside (−X direction side) of the second separation wall 46 toward the pressure chamber 42 (+X direction side) may be provided in each of the valve mechanisms 40*a* to 40*d*. In these configurations, even when the head unit 60 is not provided with the plurality of valve mechanisms 40*a* to 40*d*, the valve body 43 of each of the valve mechanisms 40*a* to 40*d* may be opened. Also in this configuration, the same effects as those in Embodiments 1 and 2 are achieved.

B4. Embodiment 4

In Embodiments 1 to 3, in place of the rotation member 70 and the slide member 80, a member for pressing the second separation wall 46*a* of the first valve mechanisms 40*a* at an end in the −X direction toward the pressure chamber 42*a*, for example, an extendable member using a piezoelectric element and a solenoid may be provided. A conventional pressing mechanism may be adopted as such member. Also in this configuration, the same effects as those in Embodiments 1 to 3 are achieved.

B5. Embodiment 5

In Embodiment 1 to 4, the plurality of valve mechanisms 40*a* to 40*d* may be annularly arranged. In such configuration, the second separation wall 46*a* to 46*d* of the adjacent valve mechanisms 40*a* to 40*d* may be deformed by pressing without providing any pressing mechanism such as the rotation member 70 and the slide member 80, thereby opening the valve body 43*a* to 43*d* of the adjacent valve mechanisms 40*a* to 40*d*. Also in this configuration, the same effects as those in Embodiments 1 to 4 are achieved.

B6. Embodiment 6

Figure 9:
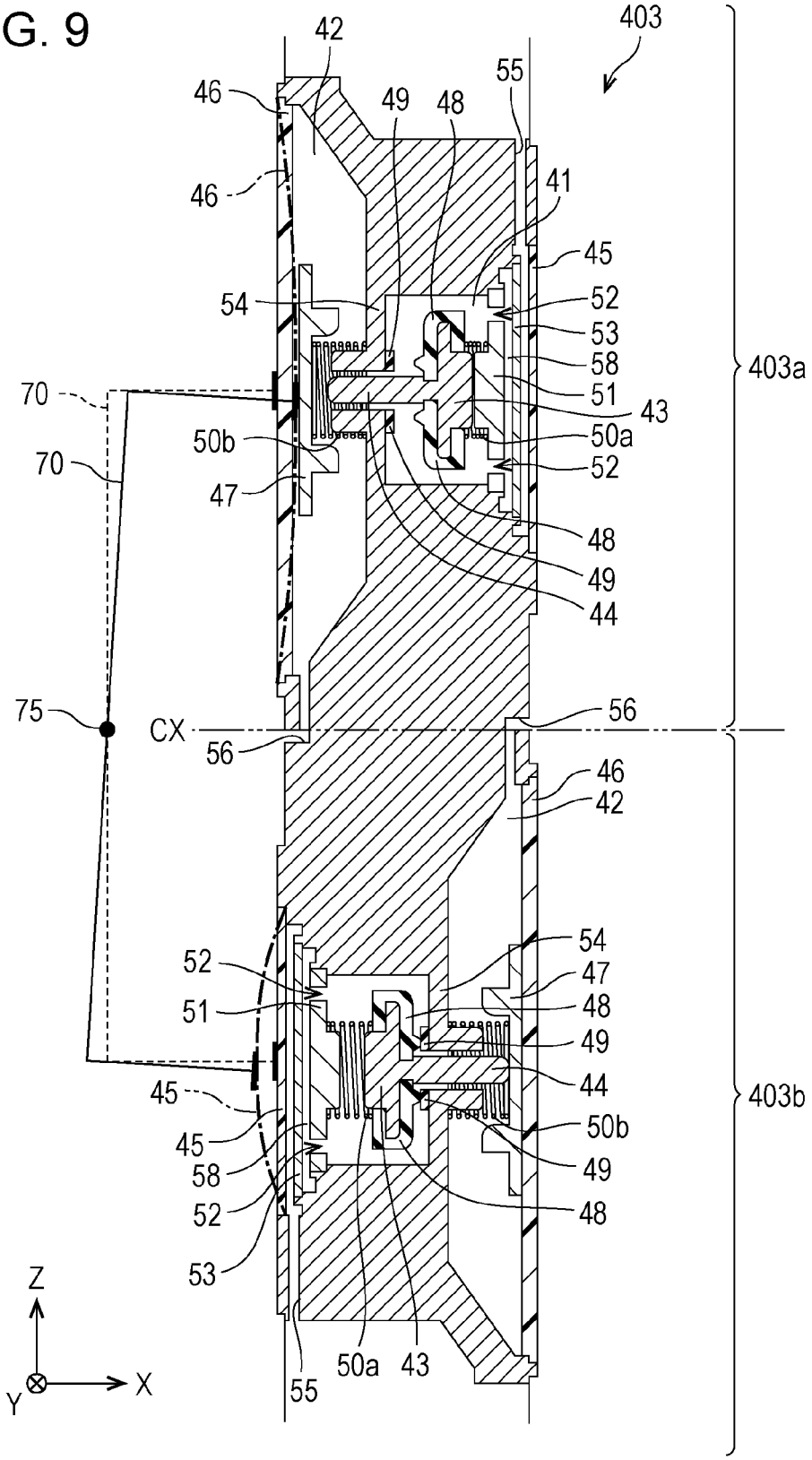
FIG. 9 is a sectional view schematically illustrating the configuration of a valve mechanism group in accordance with Embodiment 6.

FIG. 9 is a sectional view schematically illustrating the configuration of a valve mechanism group 403 in accordance with Embodiment 6. The valve mechanism group 403 is configured by integrating two valve mechanisms 403*a* and 403*b*. The valve mechanisms 403*a* and 403*b* each have the same configuration as the valve mechanism 40 of the above-described embodiments. As illustrated in FIG. 9, the valve mechanisms 403*a* and the valve mechanisms 403*b* are symmetrically disposed with respect to a central axes CX in the Z direction. That is, the valve mechanism 403*a* and the valve mechanism 403*b* have opposite valve opening directions of the respective valve bodies 43.

As illustrated in FIG. 9, the valve mechanism group 403 includes the above-mentioned rotation member 70. The rotation member 70 is disposed such that the first separation wall 45 of the lower valve mechanism 403*b* is deformed in the −X direction to press the second separation wall 46 of the upper valve mechanism 403*a* in the +X direction. When the first separation wall 45 of the lower valve mechanisms 403*b* is bent in the −X direction as represented by a dashed line, the rotation member 70 rotates in parallel to the X-Z plane as represented by a solid line. Then, as represented by a dashed line, the second separation wall 46 of the upper valve mechanisms 403*a* is pressed to be deformed toward the pressure chamber 42 (+X direction) of the valve mechanism 403*a*. Then, the pressure reception plate 47 of the valve mechanism 403*a* moves toward the partition wall 54, and the valve body 43 moves toward the valve opening direction. At this time, in the valve mechanism 403*a*, the pressure cleaning may be performed by supplying ink with the cleaning pressure. The rotation member 70 may be disposed also on the +X direction side of the valve mechanism group 403. That is, the rotation member 70 may be disposed such that the first separation wall 45 of the upper valve mechanism 403*a* is deformed in the +X direction to press the second separation wall 46 of the lower valve mechanism 403*b* in the −X direction. The valve mechanism 403*a* and the valve mechanism 403*b* may be symmetrically disposed with respect to the central axes CX in the Y direction. Also in this configuration, the same effects as those in each of the above-described embodiments are achieved.

B7. Embodiment 7

In Embodiment 6, the valve mechanism group 403 includes the two valve mechanisms 403*a* and 403*b*. However, the number of the valve mechanisms is not limited to two and the two or more valve mechanisms 40 may be provided. In the valve mechanism group 403, the rotation member 70 may be disposed such that the first separation wall 45 of the upper valve mechanisms 403*a* is deformed in the +X direction to press the second separation wall 46 of the lower valve mechanisms 403*b* in the −X direction. For example, in place of the rotation member 70, the slide member 80 or a conventional pressing mechanism may be provided. Also in this configuration, the same effects as those in Embodiment 6 are achieved.

B8. Embodiment 8

In Embodiments 6 and 7, in the valve mechanism group 403, the valve mechanisms 403*a* and 403*b* are symmetrically disposed with respect to the Z direction and however, the valve mechanisms 403*a* and 403*b* may not be symmetrically disposed. In the case where the plurality valve mechanism groups are aligned in the X direction, any of the rotation member 70, the slide member 80, and the conventional pressing mechanism may be provided on the valve mechanism groups located on both ends in the X direction. Also in this configuration, the same effects as those in Embodiments 6 and 7 are achieved.

B9. Embodiment 9

Figure 10:
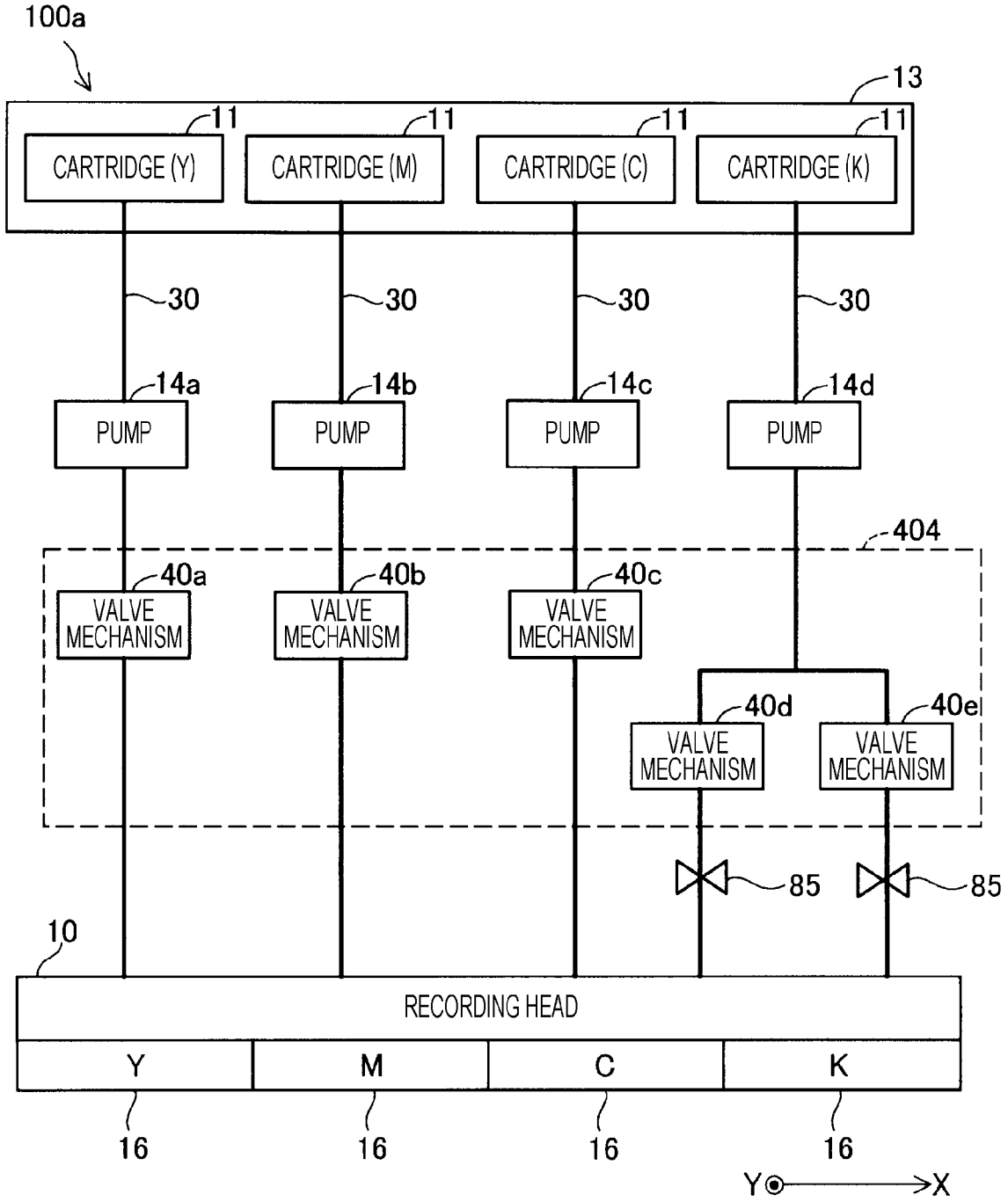
FIG. 10 is a view schematically illustrating the configuration of a part of a liquid ejecting apparatus in accordance with Embodiment 9.

FIG. 10 is a view schematically illustrating the configuration of a part of a liquid ejecting apparatus 100*a* in accordance with Embodiment 9. The liquid ejecting apparatus 100*a* in Embodiment 9 is different from the liquid ejecting apparatus 100 in the above-described embodiment in that a valve mechanism 404 is provided in place of the valve mechanism 40. The valve mechanisms 404 includes a mechanisms 40*e* in addition to the valve mechanisms 40*a* to 40*d*. Black ink is supplied to both the valve mechanism 40*d* and the valve mechanism 40*e*. Both the valve mechanism 40*d* and the valve mechanism 40*e* are commonly connected to the pump 14*d*. On-off valves 85 are provided in respective liquid paths 30 between the valve mechanisms 40*d* and 40*e* and the recording head 10*a*. By providing the on-off valves 85 downstream of the plurality of valve mechanisms 40*d* and 40*e* to which ink of the same color is supplied as described above, the amount of the ink supplied to the recording head 10 may be accurately controlled. Also in this configuration, the same effects as those in each of the above-described embodiments are achieved.

B10. Embodiment 10

Figure 11:
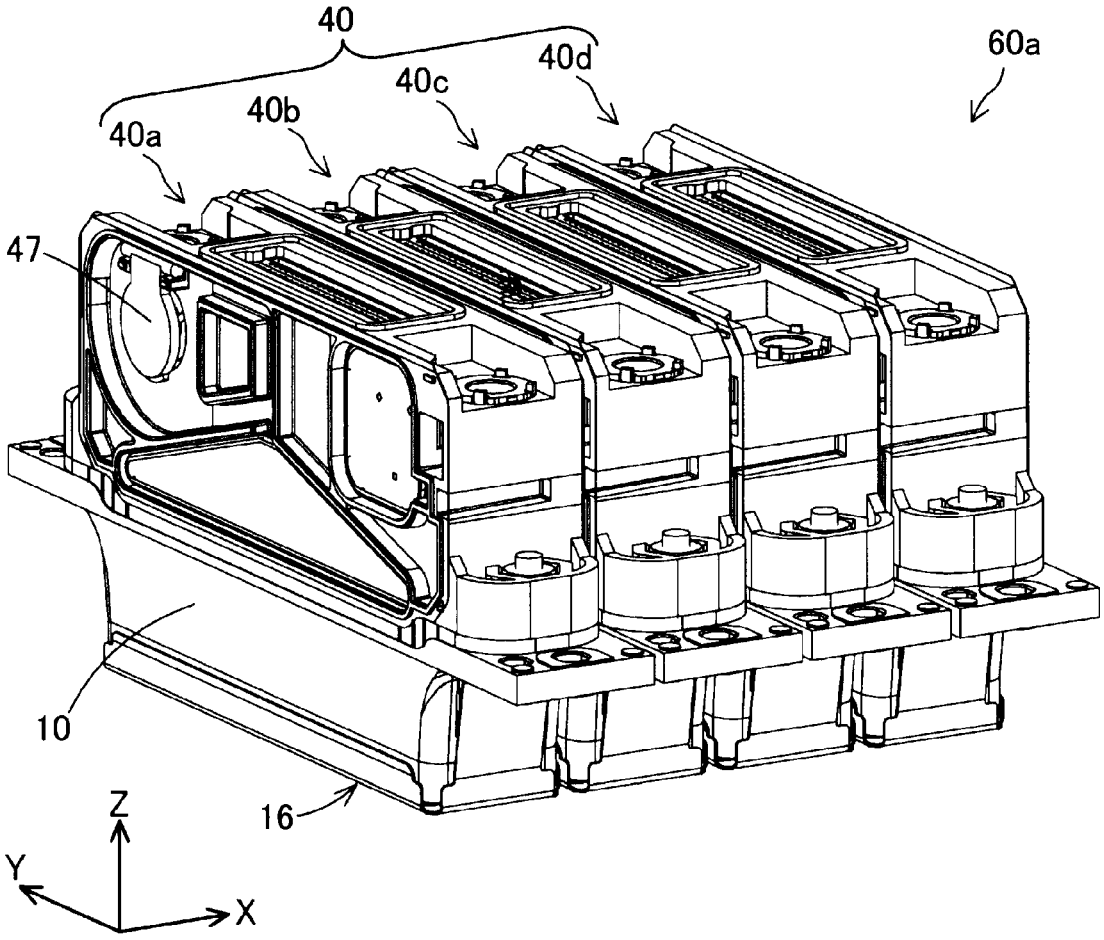
FIG. 11 is a perspective view illustrating the appearance of a head unit in accordance with Embodiment 10.

FIG. 11 is a perspective view illustrating the appearance of a head unit 60*a* in accordance with Embodiment 10. The head unit 60*a* in Embodiment 10 is different from the head unit 60 in the embodiment illustrated in FIG. 2 in that the recording heads 10 and the valve mechanisms 40 are integrally formed. Also in this configuration, the same effects as those in each of the above-described embodiments are achieved.

B11. Embodiment 11

In each of the above-described embodiments, each of the valve mechanisms 40*a* to 40*d* is associated with one nozzle row. On the contrary, one valve mechanism 40 may be associated with a plurality of nozzle rows of the same color, or one valve mechanism 40 may be provided for each type of ink. One valve mechanism 40 may be associated with a nozzle group consisting of a plurality of nozzles in place of the nozzle row. Also in this configuration, the same effects as those in each of the above-described embodiments are achieved.

B12. Embodiment 12

In each of the above-described embodiments, the pressure of ink supplied to the third valve mechanism 40*c* to be cleaned may be controlled to the pressure with which the valve bodies 43*a*, 43*b*, and 43*d* of the other valve mechanisms 40*a*, 40*b*, and 40*d* not to be cleaned are opened. In this manner, the valve bodies 43*a* to 43*d* of the plurality of valve mechanisms 40*a* to 40*d* may be simultaneously opened. Accordingly, the nozzles of the plurality of valve mechanisms 40*a* to 40*d* may be simultaneously cleaned by discharging ink from the nozzles 16 in the plurality of valve mechanisms 40*a* to 40*d*.

B13. Embodiment 13

In each of the above-described embodiments, the pressure control section 90 controls the pressure of the liquid supplied by the pump 14 to open the valve body 43, thereby performing the pressure cleaning. However, in place of or in addition to the pressure cleaning, presence or absence of clogging of the nozzles 16 may be checked, or the passage of liquid in the flow path provided in the recording head 10 may be checked. The pressure control section 90 may control the pressure of the liquid supplied by the pump 14 to open the valve body 43, thereby initially filling ink into the recording head 10. Also in this configuration, the same effects as those in each of the above-described embodiments are achieved.

B14. Embodiment 14

In each of the above-described embodiments, the pumps 14*a* to 14*d* are provided in the liquid paths 30 upstream of the respective valve mechanisms 40. Alternatively, for example, in the configuration in which liquid storage sections such as sub-tanks are provided downstream of the cartridges 11 and upstream of the valve mechanisms 40, the liquid storage sections may be provided with the pumps 14*a* to 14*d*. That is, generally, the pumps 14*a* to 14*d* only need to be provided downstream of the cartridges 11 and upstream of the valve mechanisms 40. Also in this configuration, the same effects as those in each of the above-described embodiments are achieved.

B15. Embodiment 15

In each of the above-described embodiments, the liquid ejecting apparatus 100 is the off-carriage type ink jet printer. However, the present disclosure is not limited to this type of printer. For example, an on-carriage type ink jet printer may be adopted, and an ink tank may be used in place of the cartridge 11. Liquid ejected from the nozzle 16 may be liquid other than ink. Examples of the liquid include:

1. color materials used to manufacture color filters for image display apparatuses such as liquid crystal displays;
2. electrode materials used to form electrodes for organic Els (ElectroLuminescence) display and field emission displays (FED);
3. liquid including bio-organic matters used to manufacture bio-chips;
4. samples as precision pipettes;

5. lubricating oil;
6. resin liquid;
7. transparent resin liquid such as ultraviolet curable resin liquid used to form micro hemispherical lenses (optical lenses) for optical communication elements;
8. liquid that ejects acidic or alkali etching liquid used to etch substrates or the like; and
9. any other minute quantity of droplet.

The "droplet" used herein means the state of liquid ejected from the liquid ejecting apparatus 100, and includes one trailing in the form of particle, tear, or thread. The "liquid" used herein may be any other material consumed by the liquid ejecting apparatus 100. For example, the "liquid" may be any material in the liquid phase, and includes high or low viscous liquid materials, as well as liquid inorganic solvents and organic solvents, solutions, liquid resins, and liquid metals (metal melts). The "liquid" also includes liquid as one material state, as well as solid functional particles such as pigments and metal particles melted in, dispersed in, or mixed with solvents. Typical examples of the liquid include ink and liquid crystal. The ink used herein include general water-based ink and oil-based ink as well as various liquid composites such as gel ink and hot melt ink. Also in these configurations, the same effects as those in each of the above-mentioned embodiments are achieved.

B16. Embodiment 16

In each of the above-described embodiments, a part of the configuration implemented by hardware may be replaced with software, and conversely, a part of the configuration implemented by software may be replaced with hardware. In the case where some of all of the functions of the present disclosure are implemented by the software, the software (computer program) may be provided in the form of the software stored in a computer-readable recording medium. According to this disclosure, the "computer-readable recording medium" includes portable recording medium such as flexible discs and CD-ROMs, as well as internal storage devices such as various RAMs and ROMs and external storage devices fixed to a computer such as hard disc. That is, the "computer-readable recording medium" means a variety of static recording medium.

The present disclosure is not limited to the above-described embodiments and may be achieved with various configurations so as not to deviated from the subject matter. For example, to solve some or all of the above-described problems, or achieve some or all of the above-described effects, the technical features corresponding to the technical features in each of the embodiments described in SUMMARY may be replaced or combined with each other as appropriate. Unless the technical features are described to be essential in this specification, the technical features may be omitted as appropriate.

C. Other Embodiments

1. In accordance with an embodiment of the present disclosure, a liquid ejecting apparatus is provided. The liquid ejecting apparatus includes a recording head having a nozzle that ejects liquid; a pressurizing mechanism that presses the liquid and supplies the pressed liquid; a valve mechanism provided between the pressurizing mechanism and the recording head, the valve mechanism including a liquid storage chamber that stores the pressed and supplied liquid, a pressure chamber that stores that is provided closer to the recording head than the liquid storage chamber and stores the liquid, and a valve body that moves in a valve opening direction due to a negative pressure occurring in the pressure chamber, the movement of the valve body in the valve opening direction due to the negative pressure communicating the liquid storage chamber with the pressure chamber for flowing the liquid; and a pressure control section that controls a pressure of the liquid supplied from the pressurizing mechanism to the valve mechanism. The pressure control section controls the pressure of the liquid that is pressed and supplied by the pressurizing mechanism to the liquid storage chamber, to move the valve body in the valve opening direction.

The liquid ejecting apparatus in the above-described embodiment includes the recording head, the pressurizing mechanism that presses the liquid and supplies the pressed liquid, the valve mechanism that moves the valve body in the valve opening direction due to the negative pressure occurring in the pressure chamber, communicating the liquid storage chamber with the pressure chamber for flowing the liquid, and the pressure control section that controls the pressure of the liquid supplied from the pressurizing mechanism to the valve mechanism, and the pressurizing mechanism controls the pressure of the pressed liquid supplied to the liquid storage chamber, thereby moving the valve body in the valve opening direction. Thus, as compared to the configuration further including a member for moving the valve body in the valve opening direction, the valve opening operation of communicating the liquid storage chamber with the pressure chamber may be performed with simpler configuration. In addition, the configuration of the valve mechanism and the recording head may be suppressed from becoming complicated and larger.

2. In the liquid ejecting apparatus in the above-described embodiment, the valve mechanism may further include: a first separation wall that separates the liquid storage chamber from an outside of the valve mechanism, the first separation wall being elastically deformable due to a pressure in the liquid storage chamber; and a second separation wall that separates the pressure chamber from the outside of the valve mechanism, the second separation wall being elastically deformable due to pressure in the pressure chamber, and the pressure control section may control so as to make the pressure of the pressed liquid supplied to the liquid storage chamber higher than a predetermined pressure value, to deform the first separation wall such that the second separation wall deforms toward an inside of the pressure chamber, thereby communicating the liquid storage chamber with the pressure chamber. In the liquid ejecting apparatus in the above-described embodiment, the valve mechanism the valve mechanism further includes: the first separation wall that separates the liquid storage chamber from the outside of the valve mechanism, the first separation wall being elastically deformable due to the pressure in the liquid storage chamber; and the second wall that separates the pressure chamber from the outside of the valve mechanism, the second separation wall being elastically deformable due to pressure in the pressure chamber, and the first separation wall is deformed by making the pressure of the pressed liquid supplied to the liquid storage chamber higher than the predetermined pressure value, to deform the second separation wall toward the inside of the pressure chamber, thereby moving the valve body in the valve opening direction. Thus, by controlling the pressure of the pressed liquid supplied to the liquid storage chamber, the valve body may be forcibly moved in the valve opening direction to communicate the liquid storage chamber with the pressure chamber. For this reason, the valve opening operation can be realized with simple configuration.

3. In the liquid ejecting apparatus in the above-described embodiment, the valve mechanism may be disposed across the first separation wall and the second separation wall, and further include a pressing member that deforms the first separation wall to deform the second separation wall toward the inside of the pressure chamber. In the liquid ejecting apparatus in the above-described embodiment, since the valve mechanism includes the pressing member that deforms the first separation wall to deform the second separation wall toward the inside of the pressure chamber, the second separation wall may be easily deformed toward the inside of the pressure chamber.

4. In the liquid ejecting apparatus in the above-described embodiment, the plurality of valve mechanisms may be provided, the pressure control section may deform the first separation wall of one valve mechanism of the plurality of valve mechanisms to deform the second separation wall of another valve mechanism of the plurality of valve mechanisms toward the inside of the pressure chamber of the another valve mechanism, thereby communicating the liquid storage chamber of the another valve mechanism with the pressure chamber of the another valve mechanism. In the liquid ejecting apparatus in the above-described embodiment, since the first separation wall of one valve mechanism of the plurality of valve mechanisms is deformed to deform the second separation wall of another valve mechanism toward the inside of the pressure chamber of the another valve mechanism, thereby opening the valve body of the another valve mechanism, as compared to the configuration in which the plurality of valve mechanisms each include a member for moving the valve body in the valve opening direction, the valve opening operation may be performed with simple configuration. In addition, the configuration of the valve mechanism and the recording head may be prevented from becoming complicated and bulky.

5. The liquid ejecting apparatus in the above-described embodiment may further include a valve mechanism group integrally including the plurality of valve mechanisms, and in the same valve mechanism group, the valve mechanisms may be aligned in a predetermined direction such that the valve opening directions of the valve bodies of the adjacent valve mechanisms are opposite to each other, and the valve mechanisms adjacent in the predetermined direction may be disposed such that deformation of the first separation wall of one valve mechanism deforms the second separation wall of the other valve mechanism toward the inside of the pressure chamber of the other valve mechanism. The liquid ejecting apparatus in the above-described embodiment further include the valve mechanism group integrally including the plurality of valve mechanisms, and in the same valve mechanism group, the valve mechanisms are aligned in the predetermined direction such that the valve opening directions of the valve bodies of the adjacent valve mechanisms are opposite to each other, and the valve mechanisms adjacent in the predetermined direction are disposed such that deformation of the first separation wall of one valve mechanism deforms the second separation wall of the other valve mechanism toward the inside of the pressure chamber of the other valve mechanism. Thus, the valve body of each valve mechanism in the valve mechanism group may be opened with simple configuration. In addition, since the valve opening directions of the valve bodies of the adjacent valve mechanisms in the valve mechanism group are opposite to each other, that is, the second separation walls of the two adjacent valve mechanisms are alternately disposed, the valve mechanism group may be miniaturized.

6. In the liquid ejecting apparatus in the above-described embodiment, the pressure control section may perform cleaning of discharging the liquid that is pressed and supplied by the pressurizing mechanism from the nozzle. Since the liquid ejecting apparatus in this embodiment performs cleaning of discharging the liquid that is pressed and supplied by the pressurizing mechanism from the nozzle, cleaning of the nozzle may be easily performed.

7. In accordance with another embodiment of the present disclosure, there is provided a maintenance method for a liquid ejecting apparatus including: a recording head having a nozzle that ejects liquid; a pressurizing mechanism that presses the liquid and supplies the pressed liquid; and a valve mechanism provided between the pressurizing mechanism and the recording head, the valve mechanism including a liquid storage chamber that stores the pressed and supplied liquid, a pressure chamber that stores that is provided closer to the recording head than the liquid storage chamber and stores the liquid, and a valve body that moves in a valve opening direction due to a negative pressure occurring in the pressure chamber, the movement of the valve body in the valve opening direction due to the negative pressure communicating the liquid storage chamber with the pressure chamber for flowing the liquid. This maintenance method includes: controlling the pressure of the liquid supplied from the pressurizing mechanism to the valve mechanism; moving the valve body in the valve opening direction by controlling the pressure of the liquid that is pressed and supplied by the pressurizing mechanism to the liquid storage chamber; and in the state where the liquid storage chamber is communicated with the pressure chamber by moving the valve body in the valve opening direction, discharging the pressed and supplied liquid from the nozzle to clean the nozzle. According to the maintenance method in this embodiment, since the pressurizing mechanism controls the pressure of the liquid supplied to the valve mechanism to control the pressure supplied liquid, thereby moving the valve body in the valve opening direction, as compared with the configuration further including a member for moving the valve body in the valve opening direction, the valve may be opened with more simple configuration. In addition, since the pressed liquid is discharged from the nozzle in the state where the liquid storage chamber communicates with the pressure chamber to clean the nozzle, the nozzle may be easily cleaned.

8. In the maintenance method in the above-described embodiment, the liquid ejecting apparatus may include the plurality of valve mechanism, and controlling the pressure of the liquid supplied to the valve mechanism may include controlling the pressure of the liquid supplied to the valve mechanism corresponding to the nozzle to be cleaned, to the pressure with which the liquid storage chamber communicates with the pressure chamber in the valve mechanism other than the valve mechanism to be cleaned. In the maintenance method in the above-described embodiment, since the pressure of the liquid supplied to the valve mechanism corresponding to the nozzle to be cleaned is controlled to the pressure with which the liquid storage chamber communicates with the pressure chamber in the valve mechanism other than the valve mechanism to be cleaned, the valve opening operation in the plurality of valve mechanism may be simultaneously performed. Accordingly, the nozzles of the plurality of valve mechanisms may be simultaneously performed by discharging the liquid from the nozzles in the plurality of valve mechanisms.

9. In the maintenance method in the above-described embodiment, controlling the pressure of the liquid supplied to the valve mechanism may include controlling the pressure of the liquid supplied to the valve mechanism corresponding to the nozzle to be cleaned, to a pressure with which the liquid storage chamber do not communicate with the pressure chamber in the valve mechanism other than the valve mechanism to be cleaned. According to the maintenance method in this embodiment, since the pressure of the liquid supplied to the valve mechanism corresponding to the nozzle to be cleaned is controlled to the pressure with which the liquid storage chamber do not communicate with the pressure chamber in the valve mechanism other than the valve mechanism to be cleaned, cleaning may be performed only in the valve mechanism to be cleaned.

The present disclosure may be realized in various embodiments. For example, the present disclosure may be embodied as a liquid ejecting apparatus, a liquid ejecting method, a maintenance method for the liquid ejecting apparatus, a computer program for implementing the apparatus and these methods, and a recording medium that records such computer program.

What is claimed is:

1. A liquid ejecting apparatus comprising:

a recording head having a nozzle for ejecting liquid;

a pressurizing mechanism that supplies the liquid under pressure;

a valve mechanism provided between the pressurizing mechanism and the recording head, the valve mechanism including a liquid storage chamber storing the liquid supplied under pressure, a pressure chamber that is provided closer to the recording head than to the liquid storage chamber and stores the liquid, and a valve body that moves in a valve opening direction according to a negative pressure in the pressure chamber to communicate the liquid storage chamber with the pressure chamber; and a pressure control section that controls a pressure of the liquid supplied from the pressurizing mechanism to the valve mechanism, wherein the pressure control section controls the pressure of the liquid that is supplied under pressure by the pressurizing mechanism to the liquid storage chamber, to move the valve body in the valve opening direction.

2. The liquid ejecting apparatus according to claim 1, wherein the valve mechanism further includes:

a first separation wall that separates the liquid storage chamber from an outside of the valve mechanism, the first separation wall being elastically deformable according to a pressure in the liquid storage chamber; and a second separation wall that separates the pressure chamber from the outside of the valve mechanism, the second separation wall being elastically deformable according to pressure in the pressure chamber, and the pressure control section controls so as to make the pressure of the pressed liquid supplied to the liquid storage chamber higher than a predetermined pressure value, to deform the first separation wall such that the second separation wall deforms toward an inside of the pressure chamber, thereby communicating the liquid storage chamber with the pressure chamber.

3. The liquid ejecting apparatus according to claim 2, wherein the valve mechanism further includes a pressing member that is disposed across the first separation wall and the second separation wall and that deforms the first separation wall to deform the second separation wall toward the inside of the pressure chamber.

4. The liquid ejecting apparatus according to claim 3, wherein the pressure control section cleans the nozzle by discharging, from the nozzle, the liquid supplied to the nozzle under pressure with the pressurizing mechanism.

5. The liquid ejecting apparatus according to claim 2, further comprising another valve mechanisms including another pressure chamber, another liquid storage chamber, another valve body, and another second separate portion, wherein the pressure control section deforms the first separation wall of the valve mechanism to deform the other second separation wall of the other valve mechanism toward the inside of the other pressure chamber of the other valve mechanism, thereby communicating the other liquid storage chamber of the other valve mechanism with the other pressure chamber of the other valve mechanism.

6. The liquid ejecting apparatus according to claim 5, further comprising a valve mechanism group in which the valve mechanism and the other valve mechanism are formed integrally, wherein the valve mechanism and the other valve mechanism are adjacently aligned in a predetermined direction such that the valve opening direction of the valve body and another valve opening direction of the other valve body are opposite to each other, and the valve mechanism and the other valve mechanism are disposed such that deformation of the first separation wall of the valve mechanism deforms the other second separation wall of the other valve mechanism toward the inside of the other pressure chamber of the other valve mechanism.

7. The liquid ejecting apparatus according to claim 6, wherein the pressure control section cleans the nozzle by discharging, from the nozzle, the liquid supplied to the nozzle under pressure with the pressurizing mechanism.

8. The liquid ejecting apparatus according to claim 5, wherein the pressure control section cleans the nozzle by discharging, from the nozzle, the liquid supplied to the nozzle under pressure with the pressurizing mechanism.

9. The liquid ejecting apparatus according to claim 2, wherein the pressure control section cleans the nozzle by discharging, from the nozzle, the liquid supplied to the nozzle under pressure with the pressurizing mechanism.

10. The liquid ejecting apparatus according to claim 1, wherein the pressure control section cleans the nozzle by discharging, from the nozzle, the liquid supplied to the nozzle under pressure with the pressurizing mechanism.

11. A maintenance method for a liquid ejecting apparatus, the liquid ejecting apparatus comprising:

a recording head having a first nozzle for ejecting liquid;

a first pressurizing mechanism that supplies liquid under pressure; and a first valve mechanism provided between the first pressurizing mechanism and the recording head, the first valve mechanism including a first liquid storage chamber storing the liquid supplied under pressure, a first pressure chamber that is provided closer to the recording head than to the first liquid storage chamber and stores the liquid, and a first valve body that moves in a valve opening direction according to a negative pressure in the first pressure chamber to communicate the first liquid storage chamber with the first pressure chamber, the method comprising:

controlling a pressure of the liquid supplied to the first valve mechanism by the first pressurizing mechanism;

moving the first valve body in the valve opening direction by controlling the pressure of the liquid that is supplied, to the first liquid storage chamber, under pressure by the first pressurizing mechanism; and in the state where the first liquid storage chamber is communicated with the first pressure chamber by moving the valve body in the valve opening direction, discharging the liquid supplied from the first nozzle under pressure to clean the first nozzle.

12. The maintenance method according to claim 11, wherein the liquid ejecting apparatus further includes a second nozzle, and a second valve mechanism including a second pressure chamber and a second liquid storage chamber, to eject liquid from the second nozzle, and when the first nozzle is cleaned and the second nozzle is not cleaned, controlling the pressure of the liquid supplied to the first valve mechanism includes controlling the pressure of the liquid supplied to the first valve mechanism, to a pressure with which the second liquid storage chamber communicates with the second pressure chamber in the second valve mechanism.

13. The maintenance method according to claim 11, wherein the liquid ejecting apparatus further includes a second nozzle, and a second valve mechanism including a second pressure chamber and a second liquid storage chamber, to eject liquid from the second nozzle, and when the first nozzle is cleaned and the second nozzle is not cleaned, controlling the pressure of the liquid supplied to the first valve mechanism includes controlling the pressure of the liquid supplied to the first valve mechanism, to a pressure with which the second liquid storage chamber does not communicate with the second pressure chamber in the second valve mechanism.

* * * * *